US008714917B2

(12) United States Patent
Pohler et al.

(10) Patent No.: US 8,714,917 B2
(45) Date of Patent: May 6, 2014

(54) ANTI-AIRLOCK PUMP

(75) Inventors: Donald M. Pohler, North Chili, NY (US); Matthew S. Heinsler, Lyndonville, NY (US)

(73) Assignee: Liberty Pumps Inc., Bergen, NY (US)

( * ) Notice: Subject to any disclaimer, the term of this patent is extended or adjusted under 35 U.S.C. 154(b) by 578 days.

(21) Appl. No.: 13/028,102

(22) Filed: Feb. 15, 2011

(65) Prior Publication Data

US 2012/0207590 A1 Aug. 16, 2012

(51) Int. Cl.
*F04D 9/00* (2006.01)

(52) U.S. Cl.
USPC ..... 415/168.1; 415/169.1; 415/169.2; 415/169.3; 416/179; 416/182; 416/184

(58) Field of Classification Search
USPC ..... 415/168.1, 169.1, 169.2, 169.3; 416/179, 182, 184
See application file for complete search history.

(56) References Cited

U.S. PATENT DOCUMENTS

| | | | | |
|---|---|---|---|---|
| 3,526,465 A | | 9/1970 | Compton | |
| 4,256,436 A | * | 3/1981 | Fandrey et al. | 415/143 |
| 4,776,758 A | * | 10/1988 | Gullichsen | 415/169.1 |
| 4,981,413 A | * | 1/1991 | Elonen et al. | 415/115 |
| 5,167,678 A | | 12/1992 | Elonen et al. | |
| 5,779,439 A | * | 7/1998 | Dufour | 415/115 |
| 7,159,806 B1 | | 1/2007 | Ritsema | |
| 7,537,439 B2 | | 5/2009 | Pohler | |

FOREIGN PATENT DOCUMENTS

| | | |
|---|---|---|
| DE | 4432224 A1 | 3/1996 |
| EP | 0395236 A1 | 10/1990 |

OTHER PUBLICATIONS

International Search Report of Jul. 11, 2012 in copending application PCT/US2012/024595, EFS file name 20130204_13-0228102_IDS_NPL_Cite1.

* cited by examiner

*Primary Examiner* — Igor Kershteyn
(74) *Attorney, Agent, or Firm* — Patent Innovations LLC; John M. Hammond

(57) ABSTRACT

A pump having anti-airlock provisions. The pump is comprised of a volute comprised of a volute wall, and an impeller comprising back vanes on a side of the impeller that is proximate to the volute wall, with the back vanes having a length extending radially outwardly along the impeller. A bleed hole is formed in the volute wall in communication with the portion of the volute between the back vanes and the volute wall, and the exterior of the volute, such that the bleed hole is located midway along the length of the back vanes. When the pump is operating with air, liquid, or a combination of air and liquid in the volute, the bleed hole is under positive pressure with respect to the exterior of the volute. The bleed hole may be in communication with the exterior of the volute through a lateral tunnel formed in the pump.

7 Claims, 6 Drawing Sheets

ANTI-AIRLOCK PUMP

CROSS-REFERENCE TO RELATED PATENT APPLICATIONS

This application is related to commonly owned copending application Ser. No. 13/027,878, filed on the same day as this application, and titled "MACERATING APPARATUS AND METHOD," the disclosure of which is incorporated herein by reference.

BACKGROUND

1. Field of the Invention

Centrifugal and other liquid pumps, and provisions to prevent air locking of such pumps.

2. Description of Related Art

A pump is a device used to transport liquid from a lower to a higher elevation, or from a lower pressure state to a higher pressure state. Typically, an electric motor is used to spin an impeller inside a volute casing transferring energy to the liquid. In many instances, a pump is submerged in a reservoir of liquid, and its discharge is connected to a pipe that is used to convey the liquid to a higher elevation or higher pressure vessel.

A backflow prevention device such as a check valve is used to prevent the flow of liquid through the pump, once the pump has stopped. The pump starting and stopping is typically operated by a device such as a float switch, and is turned off prior to the pump sucking air. Under normal operation, the inlet of the pump is submerged and is never exposed to air during its operation.

However, malfunctions do sometimes occur, and in such circumstances, if the pump is not turned off and does suck air, then a problem may occur the next time the pump is restarted. When the check valve closes, a column of water sits on top of its mechanism and upon restarting, the pump must develop sufficient head to displace the mechanism and the liquid above it enough to resume pumping. A liquid pump is not designed to move air, and the presence of air in the volute chamber will greatly reduce the pumping performance of the pump. Under these circumstances, the pump will not develop adequate head pressure to overcome the closing force of the check valve and the static force of the liquid column acting on it. The pump impeller will spin, but no liquid will be discharged from the pump. The check valve will simply remain closed, with the liquid column above the check valve remaining motionless. A pump in this condition is referred to as being "air locked."

Many pump designs have a bleed hole in the volute wall that allows air to be expelled back into the reservoir and replaced with liquid drawn in through the pump intake. When the liquid being pumped is free of solid debris, this is quite effective. However, when solid debris, such as solids from macerated toilet effluent, or from a sewage grinder pump is suspended in the liquid, the bleed hole can become blocked with debris particles. This renders it ineffective. Many pump manufacturers suggest cleaning this hole routinely to maintain its effectiveness. However, in some installations, this is not practical from a cost or time standpoint. Additionally, for a sewage grinder pump, or a pump that is part of a macerating apparatus for a toilet, because of the unsavory contents of the liquid, this is an unpleasant maintenance task that is to be avoided.

There is therefore a need for a pump with anti-airlock capability, which capability is not disrupted by the presence of solid materials in the liquid stream being pumped.

SUMMARY

The problem of plugging of a bleed hole in the volute of a pump by particles of solids present in a liquid being pumped is solved by providing the bleed hole in a particular region relative to the energetic element of the pump. In a pump comprised of a volute and an impeller (as the energetic element) having secondary back vanes (also known as "pump-out" or "slinger" vanes) on the side of the impeller that is proximate to the volute wall, a bleed hole is provided in a particular region relative to the pump out vanes and the volute wall. The Applicant's experimental testing has demonstrated that the optimal location of the bleed hole is approximately midway along the length of the pump out vanes, as will be subsequently explained in further detail herein. The bleed hole location enables it to be of a small size so as to not reduce pump efficiency, while not becoming plugged with debris.

BRIEF DESCRIPTION OF THE DRAWINGS

The present disclosure will be provided with reference to the following drawings, in which like numerals refer to like elements, and in which.

Figure 1:
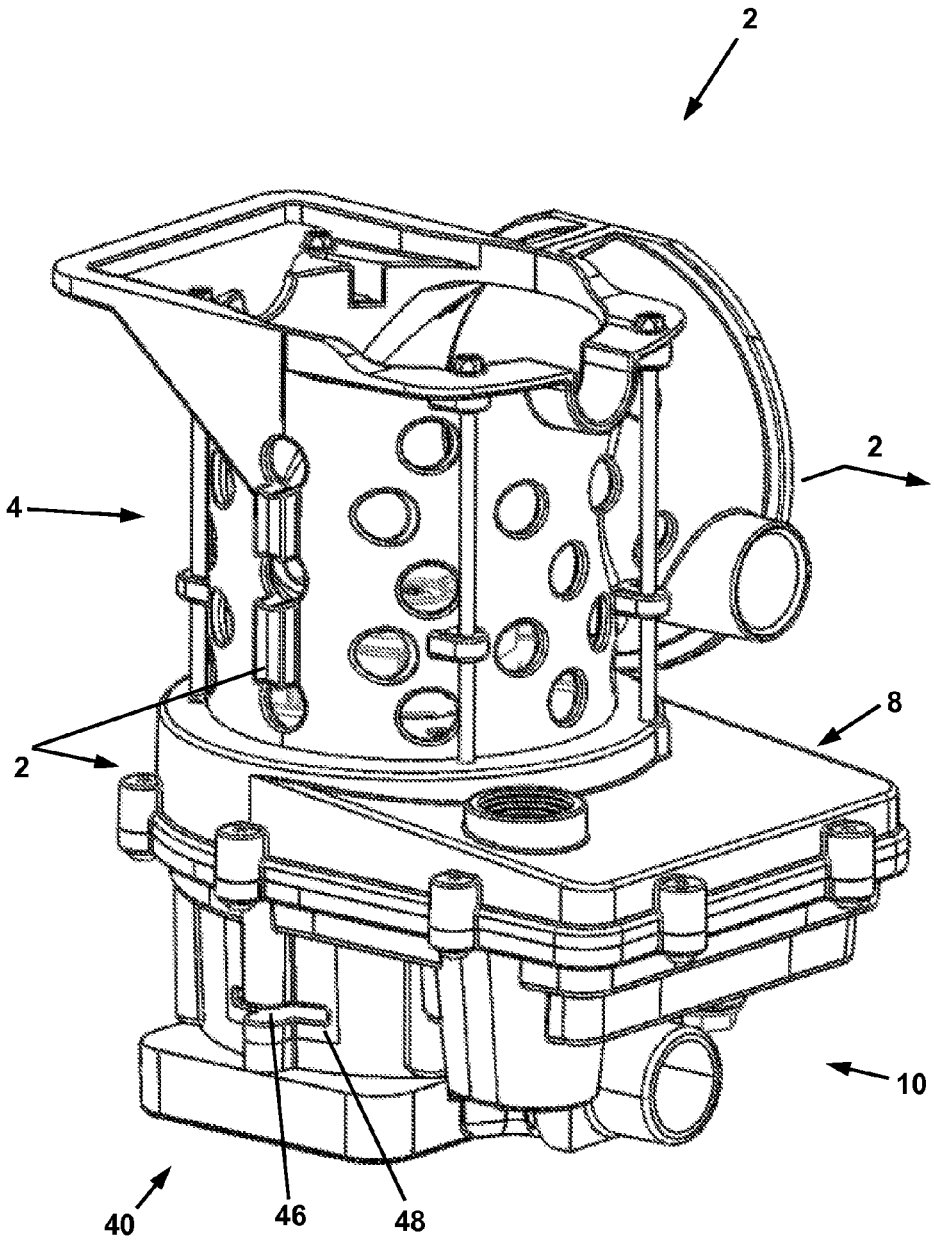
FIG. 1 is a perspective view of a toilet effluent macerating unit comprised of a centrifugal pump.
Figure 2:
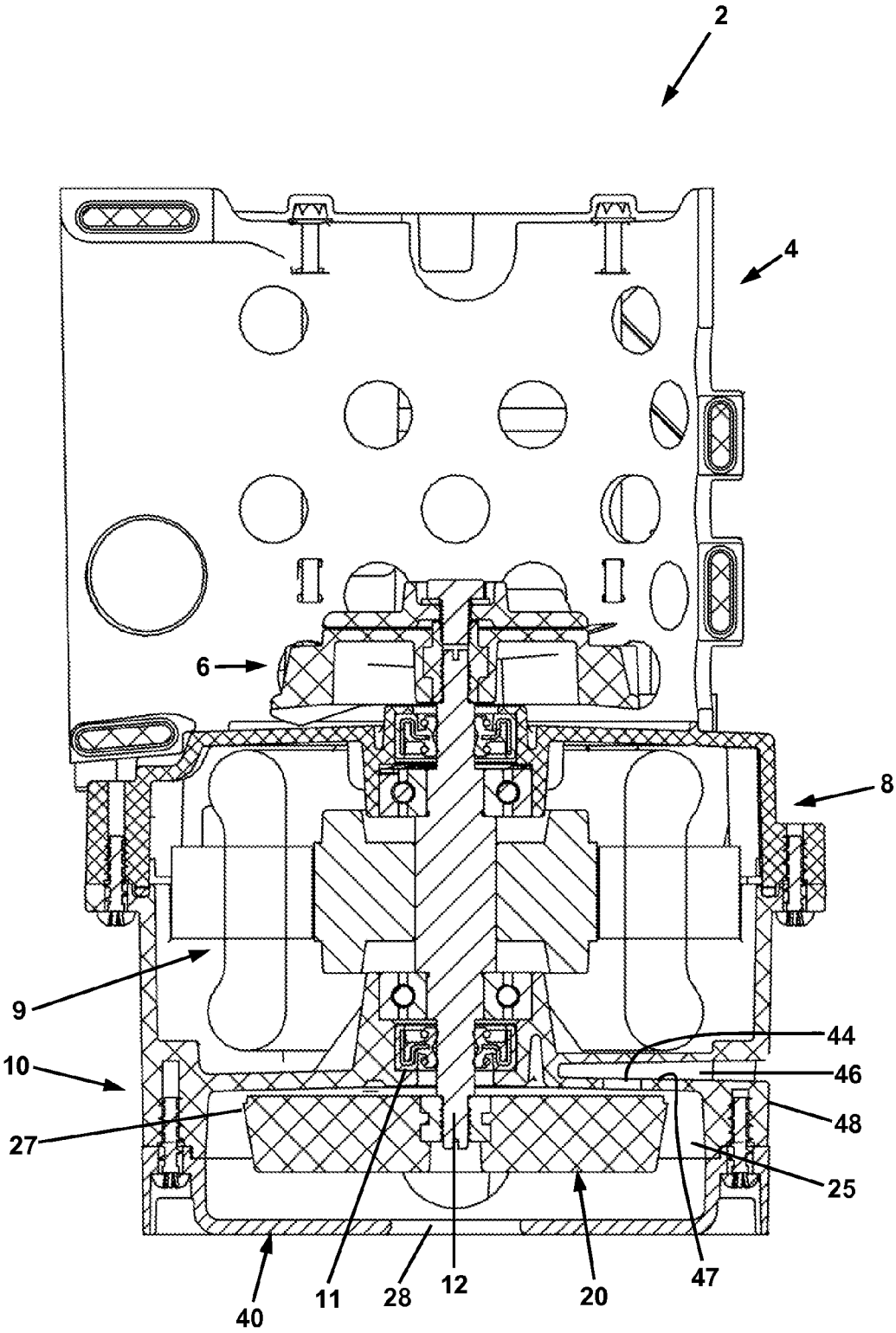
FIG. 2 is a cross-sectional view of the macerating unit and pump of FIG. 1, taken along line 2-2 of FIG. 1.
Figure 3:
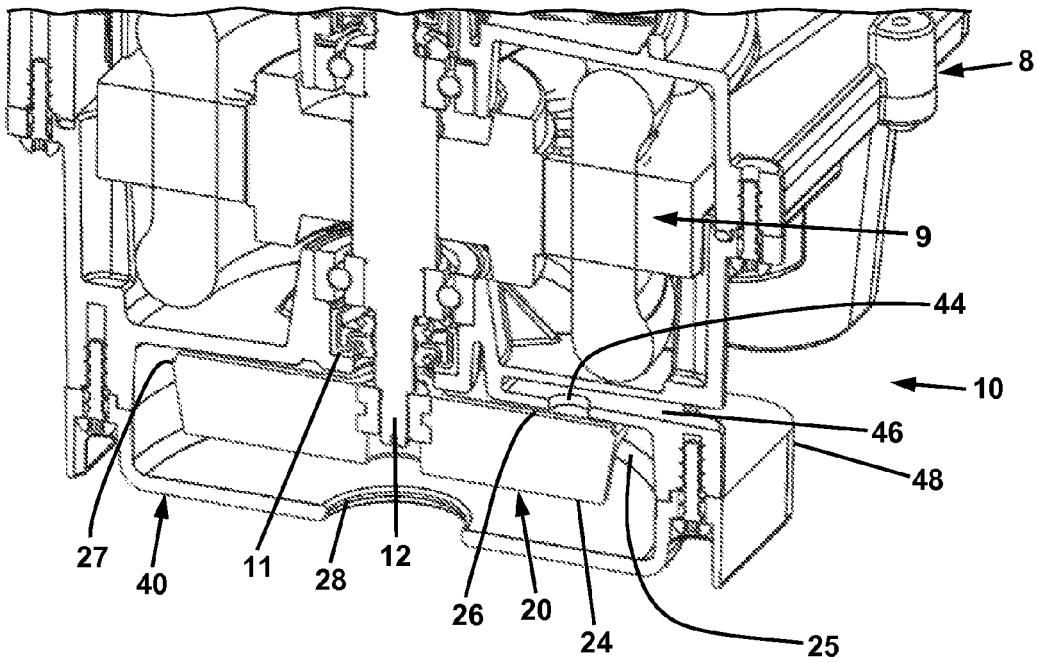
FIG. 3 is a perspective view of the pump in the cross-section of FIG. 2.
Figure 4:
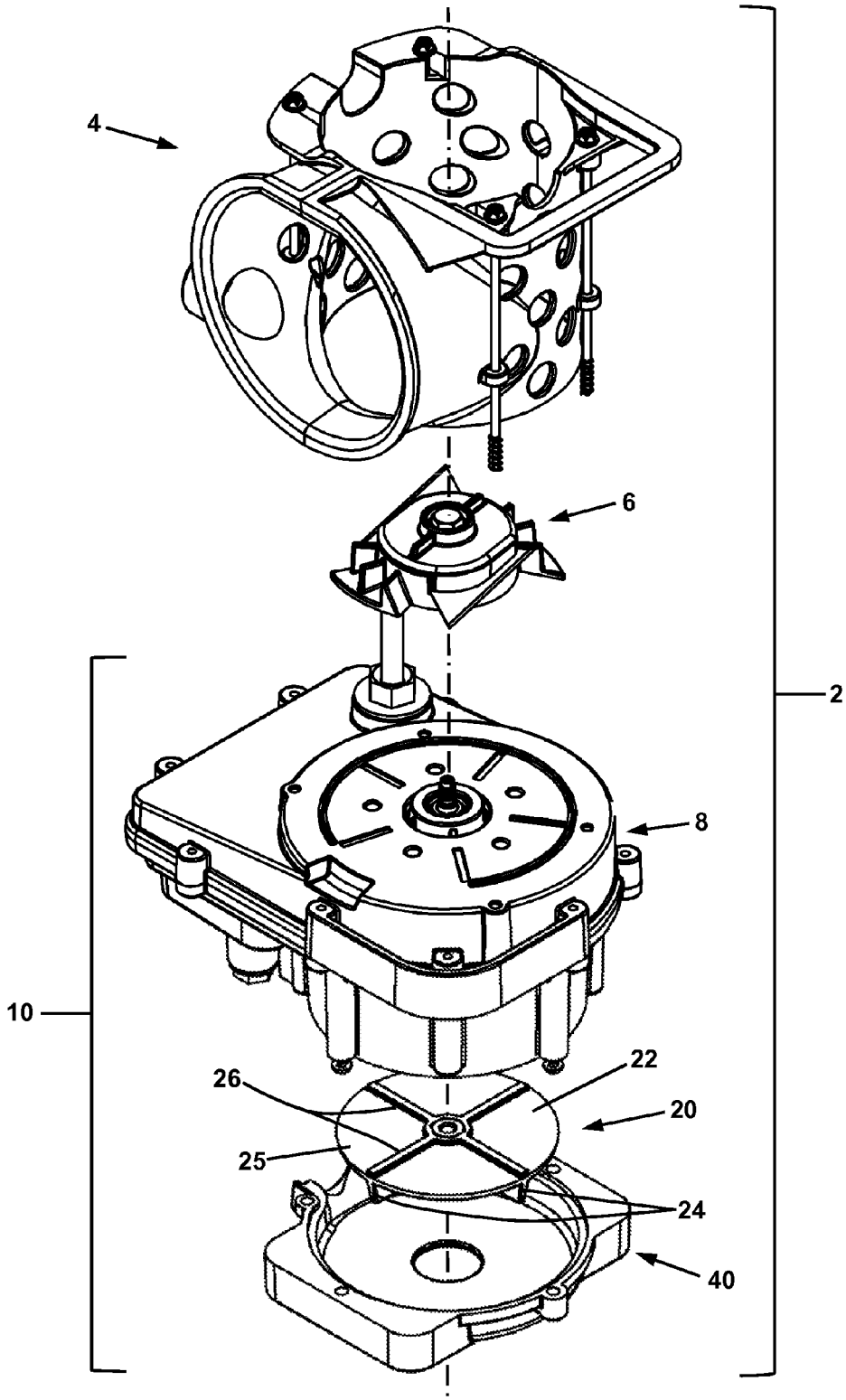
FIG. 4 is an exploded perspective view of the macerating unit and pump of FIG. 1, showing details of the pump volute and impeller.

The present invention will be described in connection with a preferred embodiment. However, it is to be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE INVENTION

For a general understanding of the present invention, reference is made to the drawings. In the drawings, like reference numerals have been used throughout to designate identical elements.

Referring to FIGS. 1-4, a macerating unit 2 is shown, which is comprised of an intake basket 4, a cutter 6, and a pump 10. The pump 10 is comprised of a rotary shaft 12 operatively connected to an impeller 20 that is contained in a volute 40. The shaft 12 may be driven by a motor 9, which may be contained in a motor enclosure 8.

The impeller 20 typically comprises a flange 22 with vanes 24 on the processing side that impart momentum into the processing fluid, thereby pumping it. On the opposite side 25 of the impeller flange 22 are smaller vanes 26 that act as slingers to prevent debris from contacting the shaft seal 11.

These slinger or pump out vanes 26 create a pressure gradient on the top side 25 of the impeller 20. The shaft seal 11 is at the lowest pressure, which increases gradually to the outer perimeter 27 of the impeller 20. The gap between the top side 25 of the impeller and the wall 42 of the volute is very small, and thus during operation of the pump 10, the liquid flow therein is turbulent due to the interaction between the impeller pump out vanes 26 and the liquid. This volume above the impeller is typically at the highest elevation with the pump 10 oriented as shown, and is thus an optimal location for a bleed hole 44 to allow any trapped air to escape the volute chamber 46. This is also an optimal location because during pump operation, the pump out vanes 26 of the impeller 20 prevent debris from entering the bleed hole 44 and thus blocking or clogging it.

Through experimental testing, the Applicant has discovered that the location of the bleed hole 44 is best approximately midway along the length of the pump out vanes 26. As used herein, "midway" is to be understood to meant that the bleed hole 44 is centered between ¼ and ¾ along the length of the pump out vanes 26, which extend from a central region of the impeller 20 to an outer region of the impeller 20. In certain embodiments, it may be more beneficial to locate the bleed hole 44 between ⅓ and ⅔ along the length of the pump out vanes 26.

It has been found that if the bleed hole 44 is close to the shaft seal 11 or center of the impeller 20, in this low pressure region, whatever fluid (air or liquid) that is present will be sucked back through the bleed hole 44. One of two conditions will exist, depending upon on the location of the bleed hole 44 relative to the level of liquid in the reservoir or tank (not shown) in which the pump is disposed. In a first condition, the inlet 28 of the volute 20 is flooded, but the upper region of the volute 20 is not flooded and the bleed hole 44 is exposed to air. In this condition, when the air has been driven from the volute chamber 25 and the pump 10 starts to move liquid and thus create positive pressure, if the bleed hole 44 is close to the shaft seal 11, air will be sucked back in through the bleed hole 44. In these circumstances, the pump 10 may still not operate correctly and may not develop adequate head to perform as designed, and break the air lock. Conversely, if liquid level in the tank is above the bleed hole 44, it will be drawn into the bleed hole 44, and macerated solids or ground sewage debris may also enter it and create a blockage, rendering the bleed hole 44 ineffective.

In contrast, with a location of the bleed hole 44 at the midway position, the opening of the bleed hole 44 will always be subjected to positive pressure from within the volute chamber 25. Thus the flow of either air or liquid will be in the outward direction through the bleed hole 44. Additionally, it has been found that if the opening of the bleed hole 44 is too close to the outer perimeter 27 of the impeller 20, the pump out vanes 26 are not effective, and debris enters and clogs the bleed hole 44.

This type of anti-air lock design with optimum positioning of the bleed hole 44 as described is effective for pumping of liquids that contain solids macerated by the macerating unit 2, as disclosed in the aforementioned co-pending U.S. patent application Ser. No. 13/027,878. In this configuration, the bleed hole location enables it to be of a small size so as to not reduce pump efficiency, while not becoming plugged with debris. In one exemplary embodiment, a pump 10 having an impeller diameter of 4 inches was provided with a volute bleed hole of 0.30 inches.

Referring again to FIGS. 1, 2, and 4, the volute 40 is provided with an additional feature that is beneficial. The volute 40 is provided with a small lateral tunnel 46 formed therein, which connects the bleed hole 44 with the open volume within the tank in which pump 10 is disposed. The tunnel 46 extends laterally from the bleed hole 44 to the outer wall 48 of the volute, and has a small vertical height compared to its length. By providing such a shielded exit to the bleed hole 44, solid particles that are present in the liquid in the tank are prevented from settling into the bleed hole 44 and plugging it in the downtime between macerating/pumping cycles. In one exemplary embodiment, an exit tunnel 389 was provided having an length of 1 inch, and a height of 0.20 inches. In general, the lateral tunnel is effective at shielding the bleed hole when it has an aspect ratio (ratio of length to smallest cross-dimension, height or width) of at least three.

Referring again to FIG. 2, the lateral tunnel 46 may have a tapered profile, or be oriented such that the lower surface 47 thereof has a downward slope. In that manner, any debris that becomes present in the lateral tunnel 46 will have a tendency to migrate away from the bleed hole 44 and be expelled outwardly from the lateral tunnel 46.

Figure 5A:
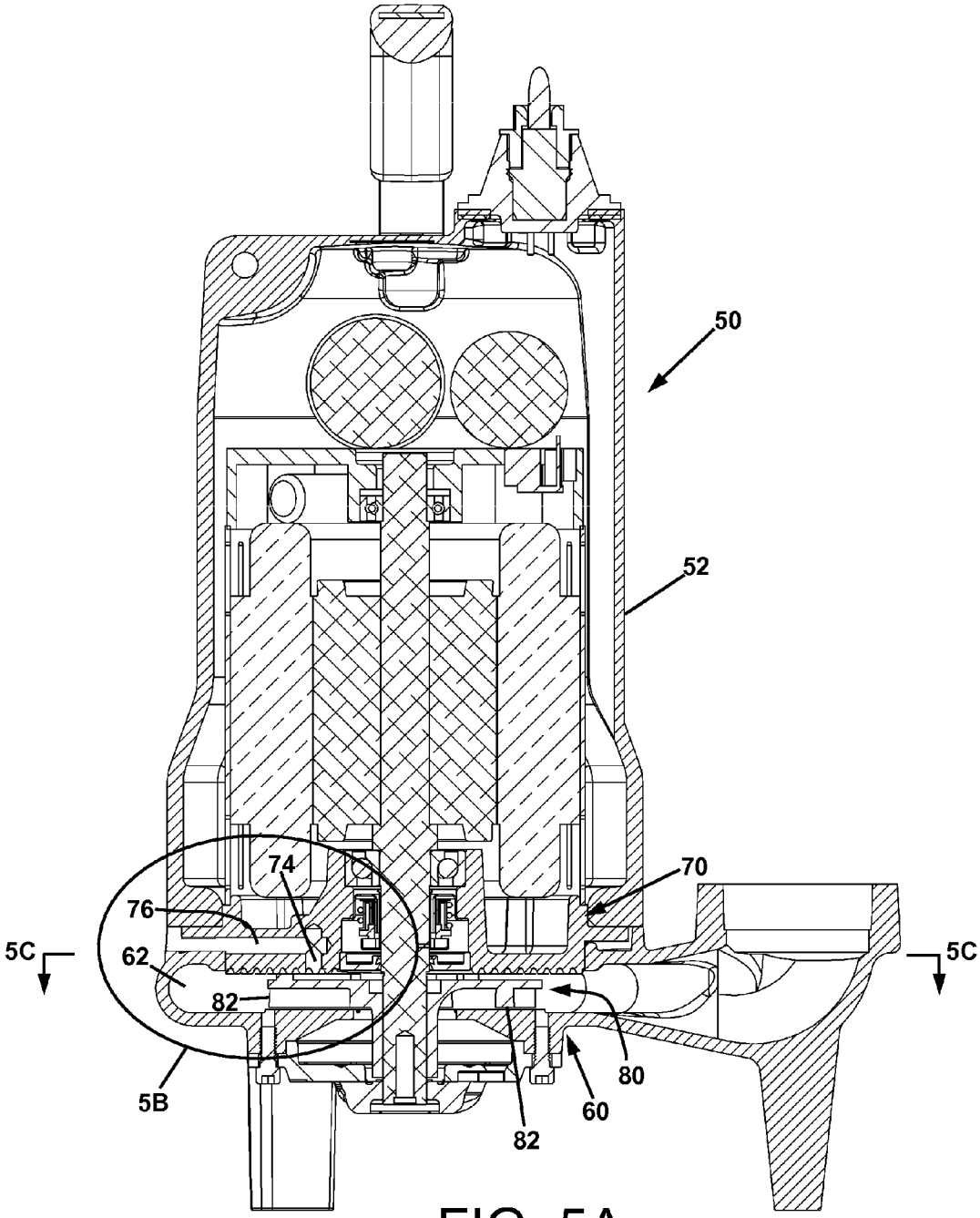
FIG. 5A is a cross-sectional view of a sewage grinding pump comprising an anti-airlock bleed hole.
Figure 5B:
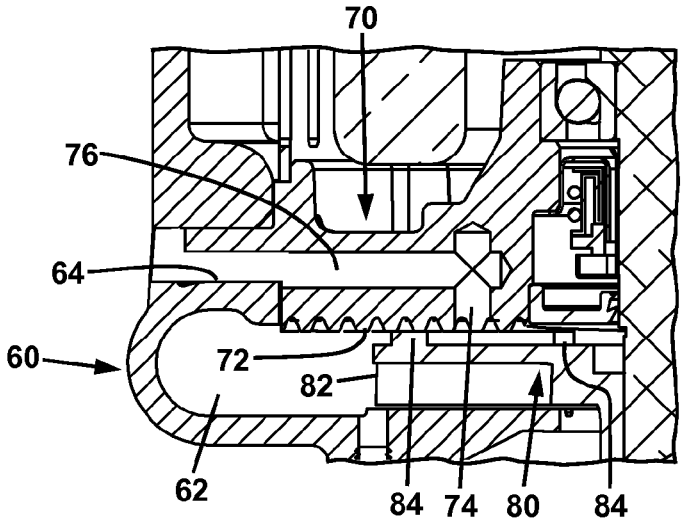
FIG. 5B is a detailed cross-sectional view of the area denoted by the ellipse 5B of FIG. 5A.

It is also effective when used in grinder pumps, such as that described in commonly owned U.S. Pat. No. 7,159,806, or other applications that involve a high loading of suspended particles. Referring to FIGS. 5A and 5B, a grinder pump 50 is shown. The grinder pump 50 is comprised of a motor housing 52, a volute housing 60, a bearing and seal housing 70, and an impeller 80. The bearing and seal housing 70 is joined to the motor housing 52, and forms the upper portion 72 of the volute in combination with the volute housing 60. The volute housing 60 is formed to provide a volute chamber 62 that surrounds the impeller 80. The volute housing 60 is joined to the motor housing 52 and is also fitted to the bearing and seal housing 70. The impeller is comprised of pumping vanes 82 on the bottom side thereof, and back vanes 84 on the top side thereof. The vanes 82 and 84 may be formed in a spiral pattern directed outwardly from the center region of the impeller 80.

Figure 5C:
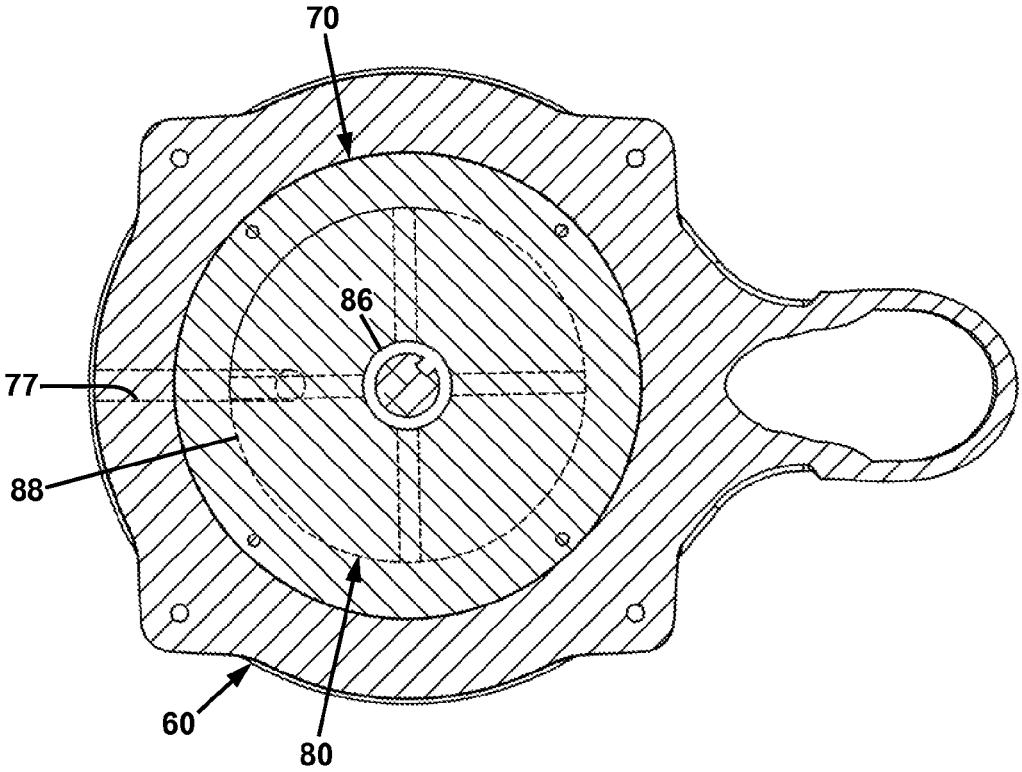
FIG. 5C is a top cross-sectional view of the pump of FIG. 5A, taken along line 5C-5C of FIG. 5A.

FIG. 5C is a top cross-sectional view of the pump of FIG. 5A, taken along line 5C-5C of FIG. 5A (but with a projection of the lateral tunnel 77 shown in dotted line). In the embodiment depicted in FIG. 5C, the back vanes 84 are shown extending from a central boss 86 radially outwardly to the outer perimeter 88 of the impeller. However, it is to be understood that the back vanes 84 do not need to extend fully outwardly across the impeller, and may extend from the central region further radially out from the central boss 86, and terminate at the outer region of the impeller further in from the impeller perimeter. This applies to both straight radial back vanes 84 and spiral or cycloidal back vanes. In these configurations, the back vanes 84 serve to provide the desired pressure gradient radially outwardly along the impeller as described previously.

A bleed hole is provided in the upper portion 72 of the volute by drilling or otherwise forming a hole 74 upwardly in the bearing and seal housing 70 midway along the length of the back vanes 84. A lateral tunnel is provided in the bearing and seal housing 70 by drilling or otherwise forming a hole 76 laterally, which connects to the bleed hole 74. This places the volute chamber 62 in communication with the volume exterior to the pump 50, and permits air to be vented when the pump is started up and air is present in the volute chamber 62. The positioning of the bleed hole 74 midway along the back vanes 84 provides the advantages of bleeding air from the volute while not significantly lowering pump efficiency and not becoming plugged with solid particles as described previously. Although the lateral hole 76 as shown in FIGS. 5A and 5B is substantially horizontal, the lateral hole 76 and other portions of the lateral tunnel may be formed with a downward slope, so as to cause any debris that becomes present in the lateral tunnel to migrate away from the bleed hole 74 and be expelled outwardly from the lateral tunnel, as described previously for the pump 10 of FIG. 2. In the embodiment shown in FIGS. 5A and 5B, an upper surface 64 of the volute housing 60 may form a portion of the lateral tunnel along with the lateral hole 76 in the bearing and seal housing 70.

It is, therefore, apparent that there has been provided, in accordance with the present invention, liquid pumps which include provisions to prevent air locking. Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims.

We claim:

1. A pump comprising:

a) a volute comprised of a volute front wall, a volute side wall, and a volute back wall enclosing a volute cavity;

b) an impeller comprising a disc-shaped flange having a front side, a back side proximate to the volute back wall, and a plurality of back vanes on the back side of the flange, wherein the back vanes have a length extending from a central region of the impeller toward an outer region of the impeller, and wherein the disc shaped flange forms a fluid-impermeable barrier between a rear portion of the volute cavity between the back vanes and the back volute wall and a front portion of the volute cavity between the front side of the flange and the front wall of the volute; and c) a bleed hole formed in the volute back wall in communication with the portion of the volute between the back vanes and the volute wall, and the exterior of the volute;

wherein the bleed hole is located midway along the length of the back vanes.

2. The pump of claim 1, wherein the bleed hole is located along the back vanes between one quarter of the way from the central region of the impeller to the outer region of the impeller and three quarters of the way from the central region of the impeller to the outer region of the impeller.

3. The pump of claim 1, wherein the bleed hole is located along the back vanes between one third of the way from the central region of the impeller to the outer region of the impeller and two thirds of the way from the central region of the impeller to the outer region of the impeller.

4. The pump of claim 1, wherein when the pump is operating with air, liquid, or a combination of air and liquid in the volute, the bleed hole is under positive pressure with respect to the exterior of the volute.

5. The pump of claim 1, wherein the bleed hole is in communication with the exterior of the volute through a lateral tunnel formed in the pump.

6. The pump of claim 5, wherein the lateral tunnel has an aspect ratio of at least three.

7. The pump of claim 5 wherein a lower surface of the lateral tunnel has a downward slope in the direction from the bleed hole to the exterior of the volute.

* * * * *